US009633631B1

(12) United States Patent
Lin et al.

(10) Patent No.: US 9,633,631 B1
(45) Date of Patent: Apr. 25, 2017

(54) FOLDABLE GUITAR

(71) Applicant: Risingguitar Ltd., Ruian (CN)

(72) Inventors: Zunyi Lin, Ruian (CN); Ruirong Lin, Ruian (CN)

(73) Assignee: Risingguitar Ltd., Ruian, Zhejiang Province (CN)

( * ) Notice: Subject to any disclaimer, the term of this patent is extended or adjusted under 35 U.S.C. 154(b) by 0 days.

(21) Appl. No.: 15/143,571

(22) Filed: Apr. 30, 2016

(30) Foreign Application Priority Data

Jan. 13, 2016 (CN) ..... 2016 1 0020508
Jan. 13, 2016 (CN) ..... 2016 1 0021589
Jan. 13, 2016 (CN) ..... 2016 2 0030094 U

(51) Int. Cl.
*G10D 1/08* (2006.01)
*G10D 3/06* (2006.01)
*G10H 3/18* (2006.01)

(52) U.S. Cl.
CPC ..... *G10D 1/085* (2013.01); *G10D 3/06* (2013.01); *G10H 3/186* (2013.01)

(58) Field of Classification Search
CPC G10G 5/00; G10G 7/005; G10G 7/00; G10D 1/085; G10D 1/08; G10D 13/026; G10D 13/028; G10D 1/02; G10D 3/00; G10H 1/32
See application file for complete search history.

(56) References Cited

U.S. PATENT DOCUMENTS 4,073,211 A * 2/1978 Jorgensen ..... G10D 3/06 84/267
5,058,479 A * 10/1991 Shaw ..... G10D 1/08 84/291
9,010,700 B1 * 4/2015 Cooper ..... G10G 5/00 248/166
2009/0071318 A1 * 3/2009 Miniaev ..... G10H 1/32 84/731
2009/0100981 A1 * 4/2009 Chadwick, V ..... G10D 1/08 84/293
2009/0151537 A1 * 6/2009 Leach ..... G10D 1/08 84/293
2015/0053063 A1 * 2/2015 Gold ..... G10C 3/12 84/423 R

* cited by examiner

*Primary Examiner* — Marlon Fletcher
(74) *Attorney, Agent, or Firm* — Shuang Chang; PSK Intellectual Property Group, LLC

(57) ABSTRACT

A foldable guitar has a guitar body. The guitar body includes a main body and a rotating bar fixed to the main body. The rotating bar has a top end and a bottom end. Each of the top end and the bottom end is pivoted to the main body. A shape of the rotating bar matches a profile shape of the main body, and the rotating bar is foldable, such that a size of the guitar body is reduced when the rotating bar is folded toward the main body.

6 Claims, 15 Drawing Sheets

FOLDABLE GUITAR

CROSS-REFERENCE TO RELATED APPLICATION

This non-provisional application claims priority under 35 U.S.C. §119(a) on Patent Application Nos. 201620030094.1, 201610020508.7, and 201610021589.2, all filed in P.R. China on Jan. 13, 2016, the entire contents of which are hereby incorporated by reference.

FIELD OF THE INVENTION

The present invention relates generally to a foldable guitar, more particularly to a foldable headless guitar that has a compact size when being folded.

BACKGROUND OF THE INVENTION

Headless electric guitars may have a variety of shapes. An electric guitar has a body, which is used for fixing strings and an amplifier thereon. The electric guitar has a large body that occupies a large space and is not convenient for being carried around or transportation. Further, the electric guitar is easily damaged due to its large size. Therefore, there is a need to design an electric guitar that is easy for carrying.

SUMMARY OF THE INVENTION

This invention provides a foldable guitar. The features are foldable upper portion contoured rotating bar with retractable lower contoured adjustable leg rest permanently attached to main body of the guitar. The purpose of this invention is to make a guitar more portable when traveling and react as a normal guitar when performing. This invention also includes the means to transform the guitar from travel mode to preforming mode without the aid of addition parts or tools to perform the transformation. The adjustable leg also provides extra user comfort by the means of locking height adjustment for the end user. Also note that the transformation process in this new invention leaves guitar tuning intact. Not requiring loosening or removal of the guitar strings.

In one aspect, the present invention relates to a foldable guitar. The foldable guitar may be an electric guitar. In one embodiment, the foldable guitar has a guitar body. The guitar body includes a main body and a rotating bar. The rotating bar having a top end and a bottom end. The top end and the bottom end are respectively pivoted to the main body. A shape of the rotating bar matches a profile shape of the main body. The rotating bar is foldable such that a size of the guitar body is reduced when the rotating bar is folded toward the main body. The main body and the rotating bar substantially forms the left portion and the right portion of the guitar body, and the rotating bar is able to rotate using the two pivoted ends. After the rotating bar rotates and folds toward the main body, the size of the guitar body is reduced to just the main body. The rotating bar may overlap with the main body, may be received in a corresponding depressed groove of the main body, or may be located outside and adjacent to the outer profile of the main body.

In certain embodiments, at least one of the top end and the bottom end of the rotating bar has a ball bearing disposed therein, an outer portion of the ball bearing receives a force pressing the ball bearing inward toward the main body, and the inner portion of the ball bearing is exposed toward the main body. The main body includes a first hole and a second hole configured to receive the ball bearing. When the ball bearing slip fits with the first hole, the rotating bar is in an extended position such that the foldable guitar can be used normally. When the ball bearing slip fits with the second hole, the rotating bar is in a folded position such that the rotating bar is folded on the main body. In one embodiment, the top end of the rotating bar has the ball bearing, and the top end of the main body has the corresponding first hole and second hole, the bottom end of the rotating bar also has another ball bearing and corresponding another first hole and another second hole. When the ball bearings are received in the corresponding first holes or second holes, the guitar body is in the fully extended or fully folded position. In one embodiments, the main body further includes two third holes at the top and bottom ends of the main body, the rotating bar is rotatably fixed to the two third holes. In one embodiment, the two third holes are located respectively between two corresponding first hole and second hole, and the third holes define a rotating axis of the rotating bar. In one embodiment, each of the third holes is located in a midpoint between the corresponding first hole and the second hole.

In certain embodiments, a set screw is placed at the outer side of the ball bearing, and the set screw is used to adjust the force pressing the ball bearing inward toward the main body. In one embodiment, the rotating bar has two receiving holes for receiving the balls. Each receiving hole receives from outside the guitar body toward the inner side of the guitar body the set screw, a spring, and the bearing ball. When the set screw is adjusted and moves via the thread of the receiving hole, the force the set screw pushes the spring changes, the spring compressed or extended more, and the elastic force of the spring performed on the bearing ball changes, and the snap fit between the rotating bar and the main body is then adjusted, such that the rotating bar can be rotate easily relative to the main body, while the rotating bar is firmly fixed to the main body in the full extended position or the fully folded compact position.

In certain embodiments, the foldable guitar further includes a retractable leg rest, a vertical support beam, and a sleeve. The retractable leg rest is fixed to the vertical support beam, the sleeve is sleeved on the vertical support beam, and the sleeve is fixed in the main body.

In certain embodiments, a receptacle the leg rest resides in allows for multiple locking positions of the leg rest, a locking positioning of the leg is performed with a spring loaded toggle bolt locking mechanism, the toggle bolt is configured such that an end user does not require any tools to activate the adjustment of the leg rest, the spring loaded toggle bolt is retractable from locking position by means of a spring loaded push button release, the toggle bolt can reside in multiple holes located in the leg rest sleeve residing in the main body of the foldable guitar.

In certain embodiments, the foldable guitar further includes an electric amplifier attachable and removable from the main body of the guitar. An output signal from the guitar vibrating string is feed into the attachable electric amplifier by means of permanent magnetic inductor or inductors. In one embodiment, when the guitar body is in a folded position, the amplifier is removed from the main body to further reduce the size of the folded guitar body.

These and other aspects of the present invention will become apparent from the following description of the preferred embodiment taken in conjunction with the following drawings, although variations and modifications therein may be effected without departing from the spirit and scope of the novel concepts of the disclosure.

BRIEF DESCRIPTION OF THE DRAWINGS

The accompanying drawings illustrate one or more embodiments of the invention and together with the written description, serve to explain the principles of the invention. Wherever possible, the same reference numbers are used throughout the drawings to refer to the same or like elements of an embodiment.

DETAILED DESCRIPTION OF THE INVENTION

Figure 1:
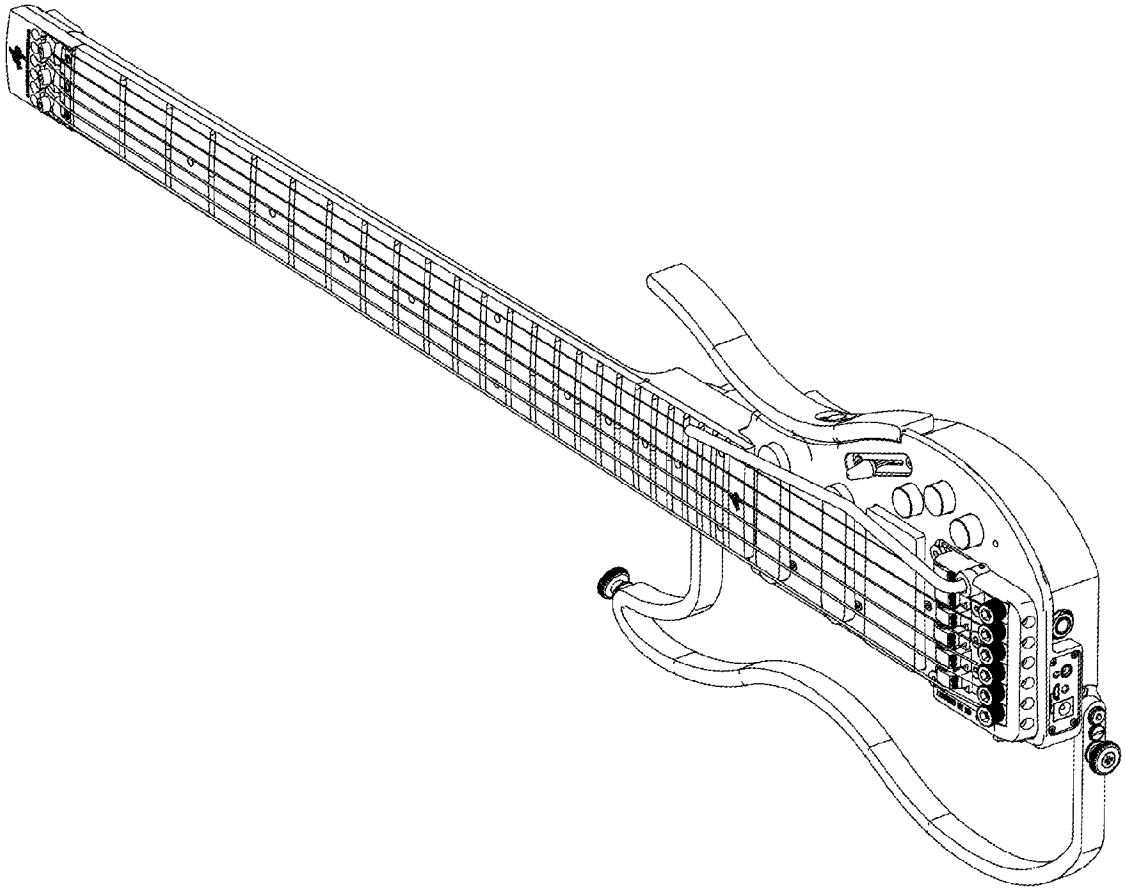
FIG. 1 schematically shows a three dimensional front view of a guitar completely assembled according to one embodiment of the present invention, where the guitar is in a completely extended or work position.

The present invention will now be described more fully hereinafter with reference to the accompanying drawings, in which exemplary embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. Like reference numerals refer to like elements throughout.

The terms used in this specification generally have their ordinary meanings in the art, within the context of the invention, and in the specific context where each term is used. Certain terms that are used to describe the invention are discussed below, or elsewhere in the specification, to provide additional guidance to the practitioner regarding the description of the invention. For convenience, certain terms may be highlighted, for example using italics and/or quotation marks. The use of highlighting has no influence on the scope and meaning of a term; the scope and meaning of a term is the same, in the same context, whether or not it is highlighted. It will be appreciated that same thing can be said in more than one way. Consequently, alternative language and synonyms may be used for any one or more of the terms discussed herein, nor is any special significance to be placed upon whether or not a term is elaborated or discussed herein. Synonyms for certain terms are provided. A recital of one or more synonyms does not exclude the use of other synonyms. The use of examples anywhere in this specification including examples of any terms discussed herein is illustrative only, and in no way limits the scope and meaning of the invention or of any exemplified term. Likewise, the invention is not limited to various embodiments given in this specification.

It will be understood that when an element is referred to as being "on" another element, it can be directly on the other element or intervening elements may be present therebetween. In contrast, when an element is referred to as being "directly on" another element, there are no intervening elements present. As used herein, the term "and/or" includes any and all combinations of one or more of the associated listed items.

It will be understood that, although the terms first, second, third etc. may be used herein to describe various elements, components, regions, layers and/or sections, these elements, components, regions, layers and/or sections should not be limited by these terms. These terms are only used to distinguish one element, component, region, layer or section from another element, component, region, layer or section. Thus, a first element, component, region, layer or section discussed below could be termed a second element, component, region, layer or section without departing from the teachings of the present invention.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising", or "includes" and/or "including" or "has" and/or "having" when used in this specification, specify the presence of stated features, regions, integers, steps, operations, elements, and/or components, but do not preclude the presence or addition of one or more other features, regions, integers, steps, operations, elements, components, and/or groups thereof.

Furthermore, relative terms, such as "lower" or "bottom" and "upper" or "top", may be used herein to describe one element's relationship to another element as illustrated in the Figures. It will be understood that relative terms are intended to encompass different orientations of the device in addition to the orientation depicted in the Figures. For example, if the device in one of the figures is turned over, elements described as being on the "lower" side of other elements would then be oriented on "upper" sides of the other elements. The exemplary term "lower", can therefore, encompasses both an orientation of "lower" and "upper", depending of the particular orientation of the figure. Similarly, if the device in one of the figures is turned over, elements described as "below" or "beneath" other elements would then be oriented "above" the other elements. The exemplary terms "below" or "beneath" can, therefore, encompass both an orientation of above and below.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and the present disclosure, and will not be interpreted in an idealized or overly formal sense unless expressly so defined herein.

As used herein, "around", "about", "substantially" or "approximately" shall generally mean within 20 percent, preferably within 10 percent, and more preferably within 5 percent of a given value or range. Numerical quantities given herein are approximate; meaning that the term "around", "about", "substantially" or "approximately" can be inferred if not expressly stated.

The description will be made as to the embodiments of the present invention in conjunction with the accompanying drawings in FIGS. 1-8. In accordance with the purposes of this invention, as embodied and broadly described herein, this invention, in one aspect, relates to a foldable guitar.

This following explanation provides description detail of the numbered items in FIGS. 1-12B including assemble and function process.

Figure 2:
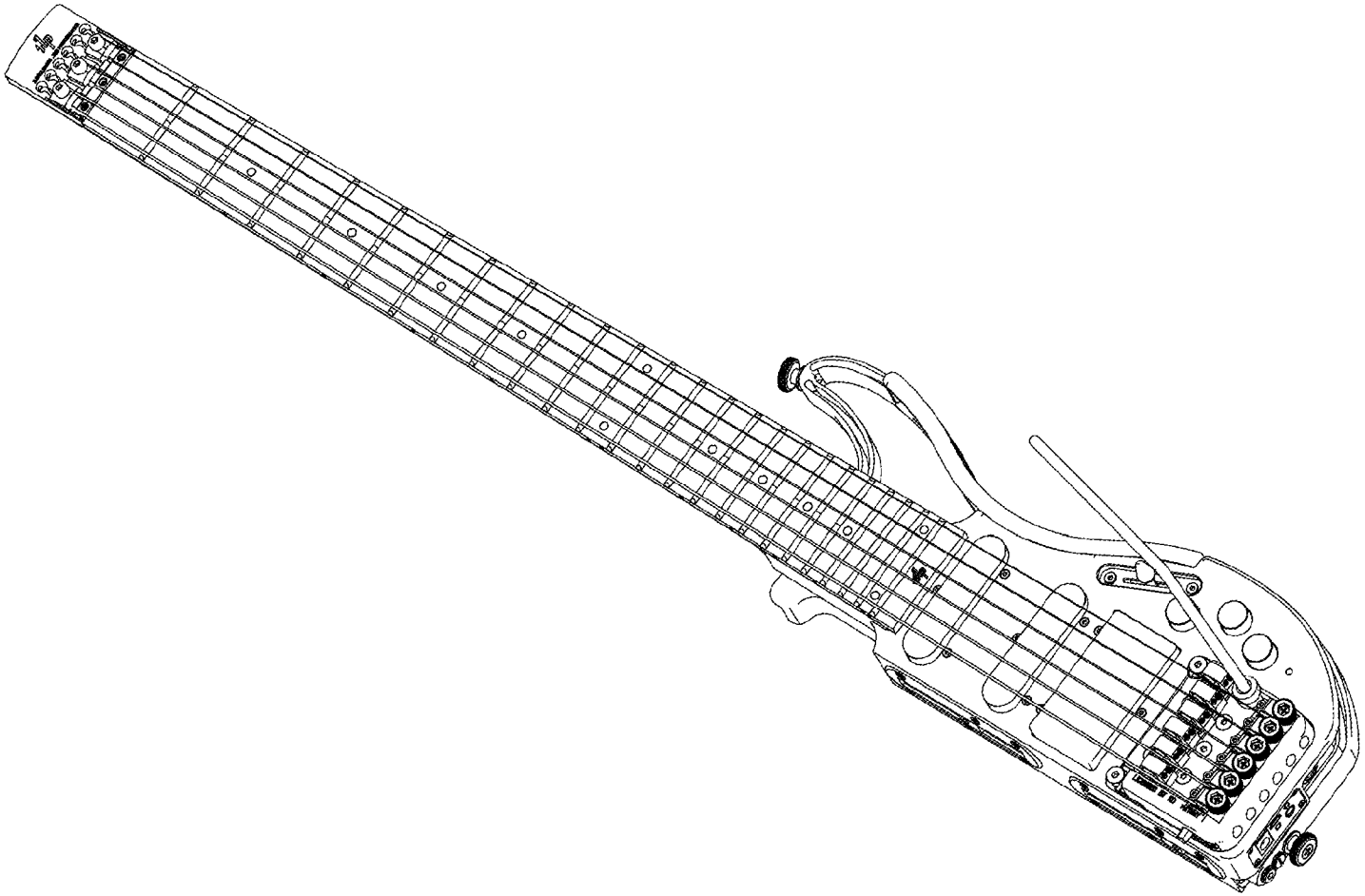
FIG. 2 schematically shows a three dimensional front view of a guitar completely assembled according to one embodiment of the present invention, where the guitar is in a completely folded position.
Figure 3:
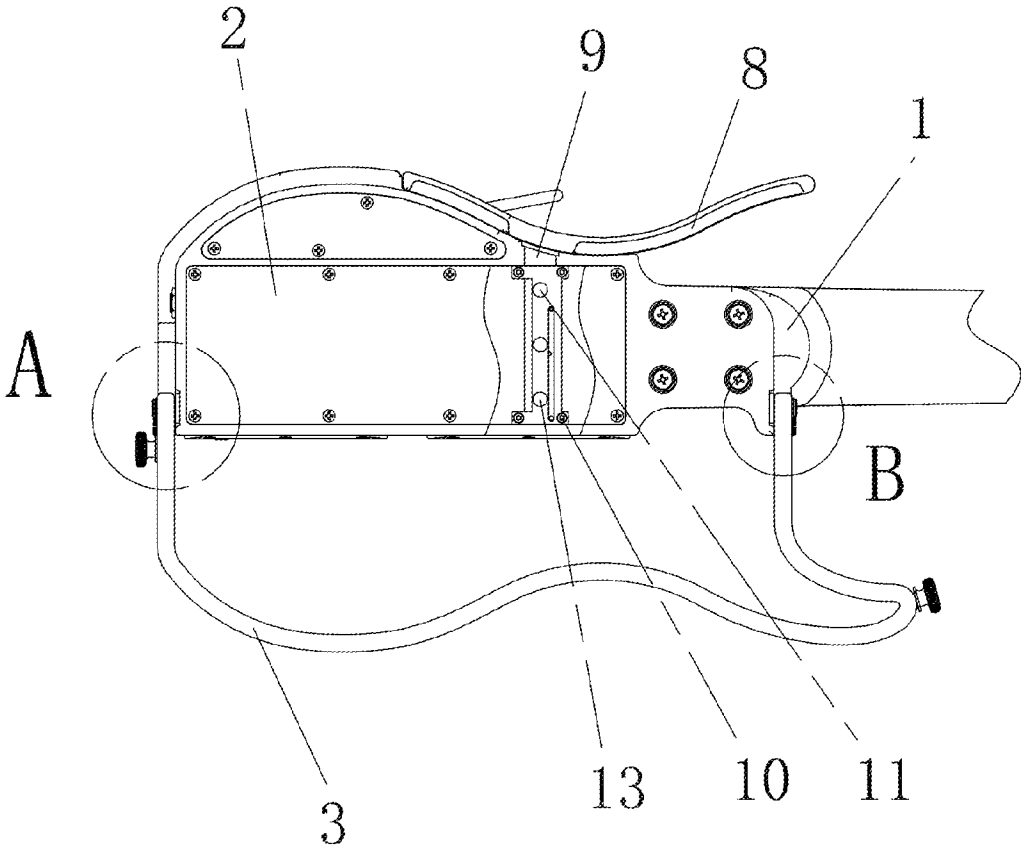
FIG. 3 shows schematically a back view of an assembled guitar body of a guitar according to one embodiment of the present invention.

As shown in FIGS. 1-3, the whole guitar body 1 includes a main body 2 and a rotating bar 3. The main body 2 and the rotating bar 3 substantially respectively form a left side portion and a right side portion of the guitar body. The rotating bar 3 is attached or hinged to the main body 2. The shape of the rotating bar 3 conforms to the shape of the main body 2. This provides a proper slip fit when the rotating bar 3 is folded onto the main body 2 to form a folded travel position. The rotating bar 3, after being folded, is located at the same side as the main body 2. This makes the whole guitar body 1 in the optimal efficient compact size, and makes the guitar easier to be shipped and carried and provides the means to prevent damage when the guitar is transported.

Figure 4A:
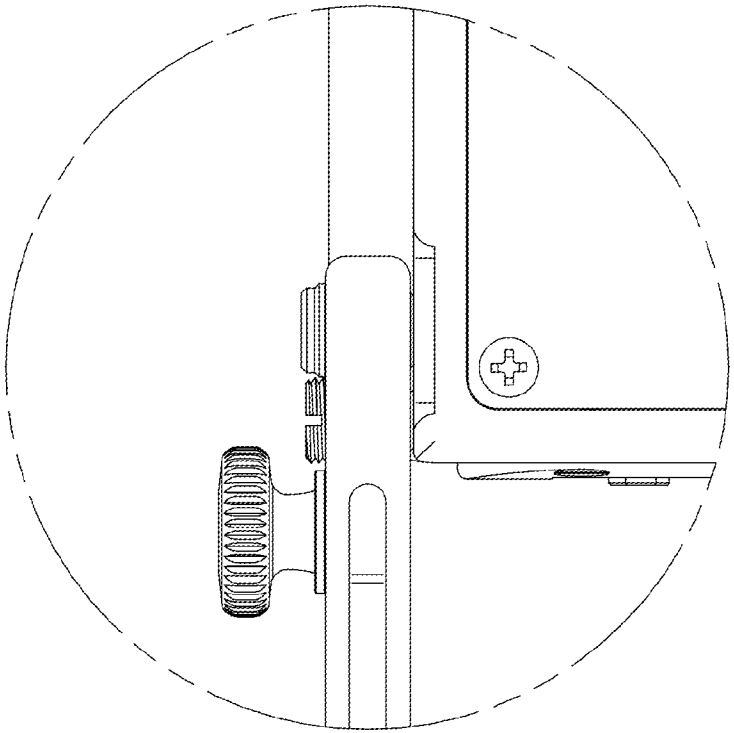
FIG. 4A shows schematically a back view of the details of a locking mechanism of a rotating bar attachment at the bottom of the guitar body according to one embodiment of the present invention.
Figure 4B:
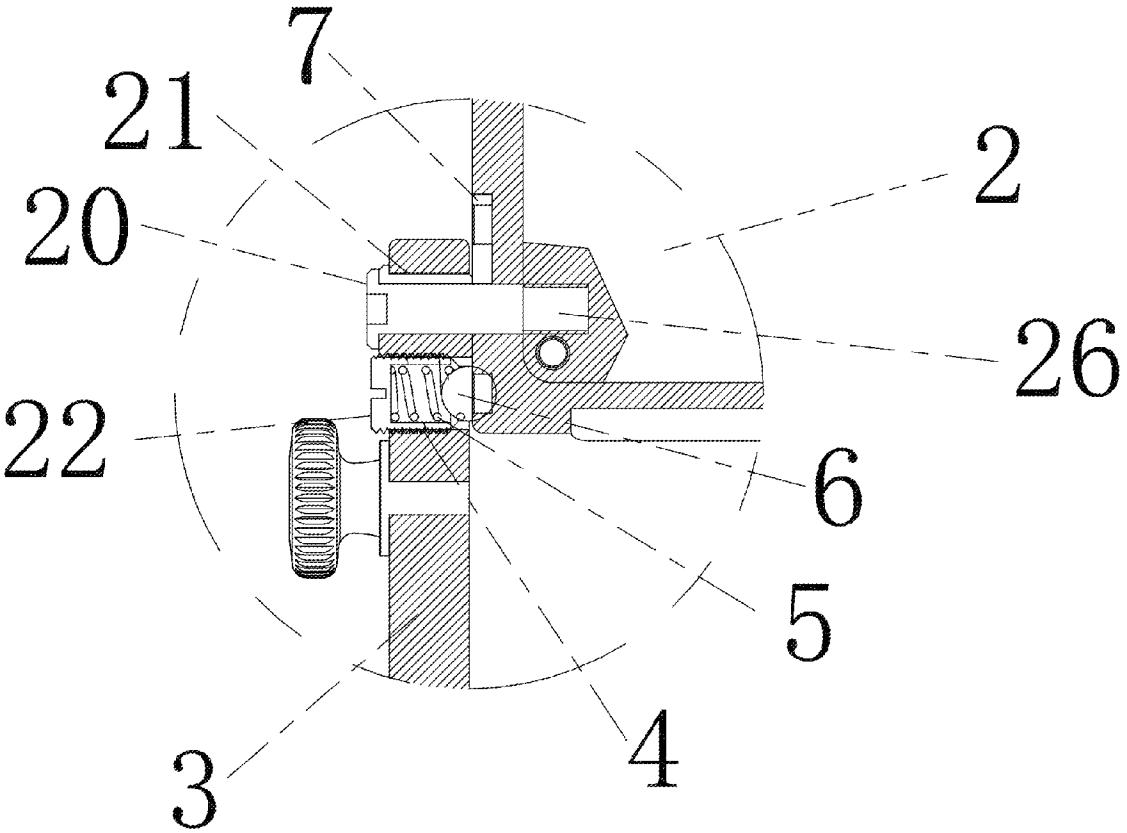
FIG. 4B is a sectional view of FIG. 4A.
Figure 5:
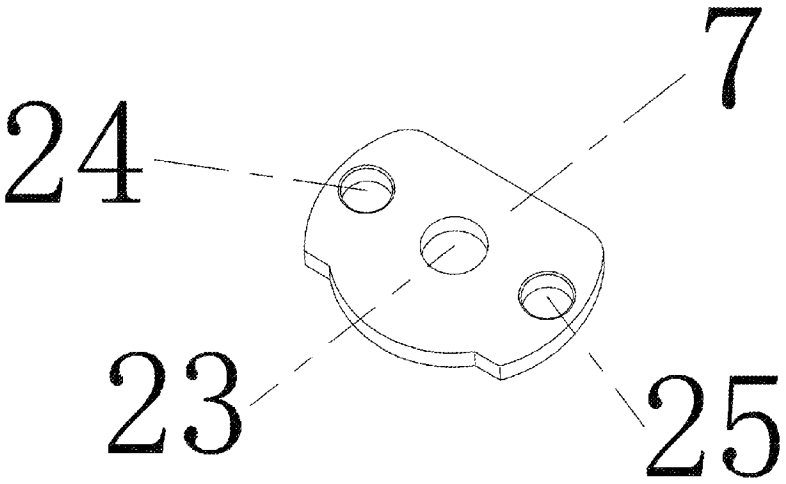
FIG. 5 shows schematically a three dimensional view of a locking plate according to one embodiment of the present invention.
Figure 6A:
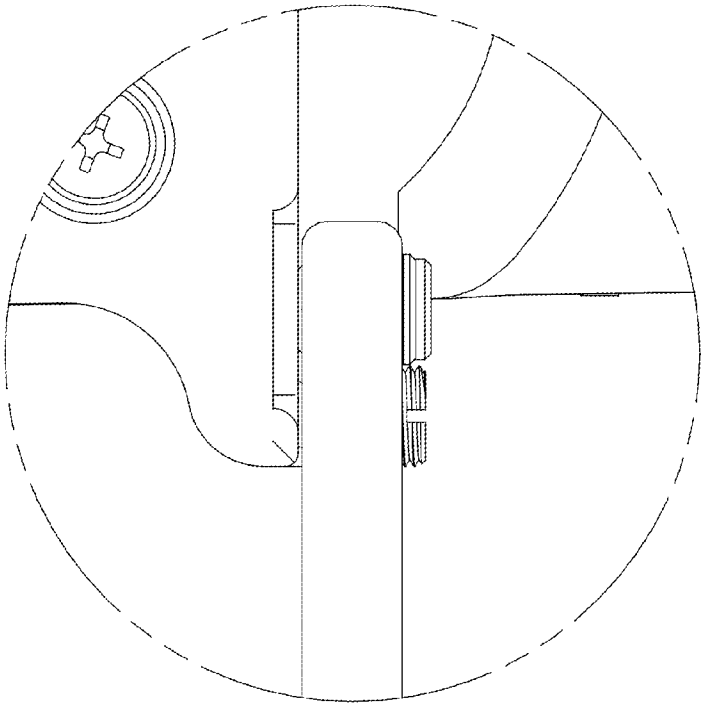
FIG. 6A shows schematically a back view of the details of a locking mechanism of a rotating bar attachment at the top of the guitar body according to one embodiment of the present invention.
Figure 6B:
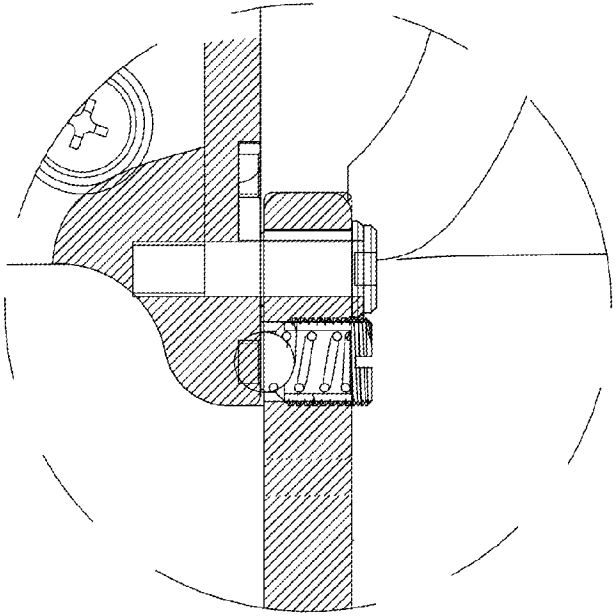
FIG. 6B is a sectional view of FIG. 6A.
Figure 7:
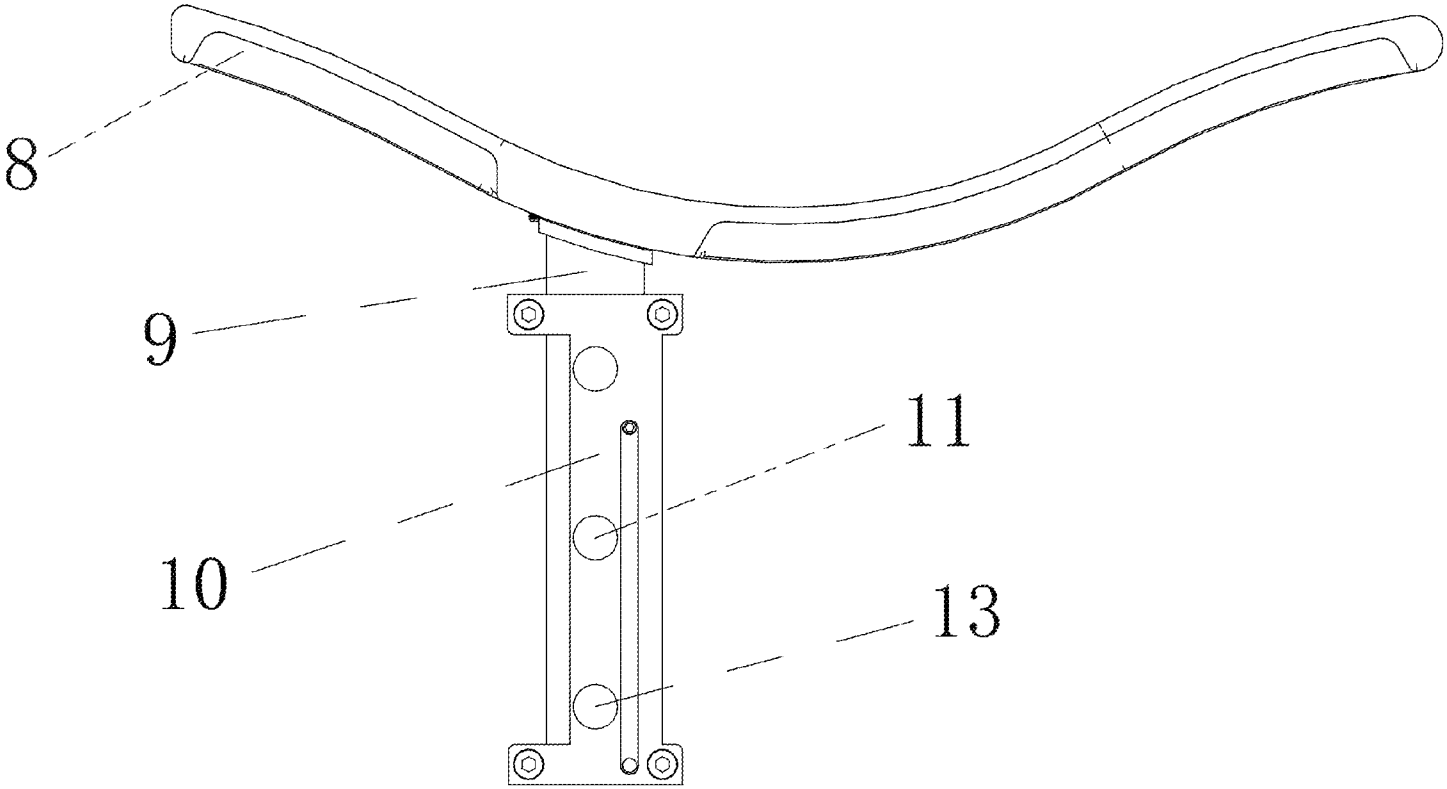
FIG. 7 shows the rear side view of a leg rest assembly with vertical beam according to one embodiment of the present invention.
Figure 8:
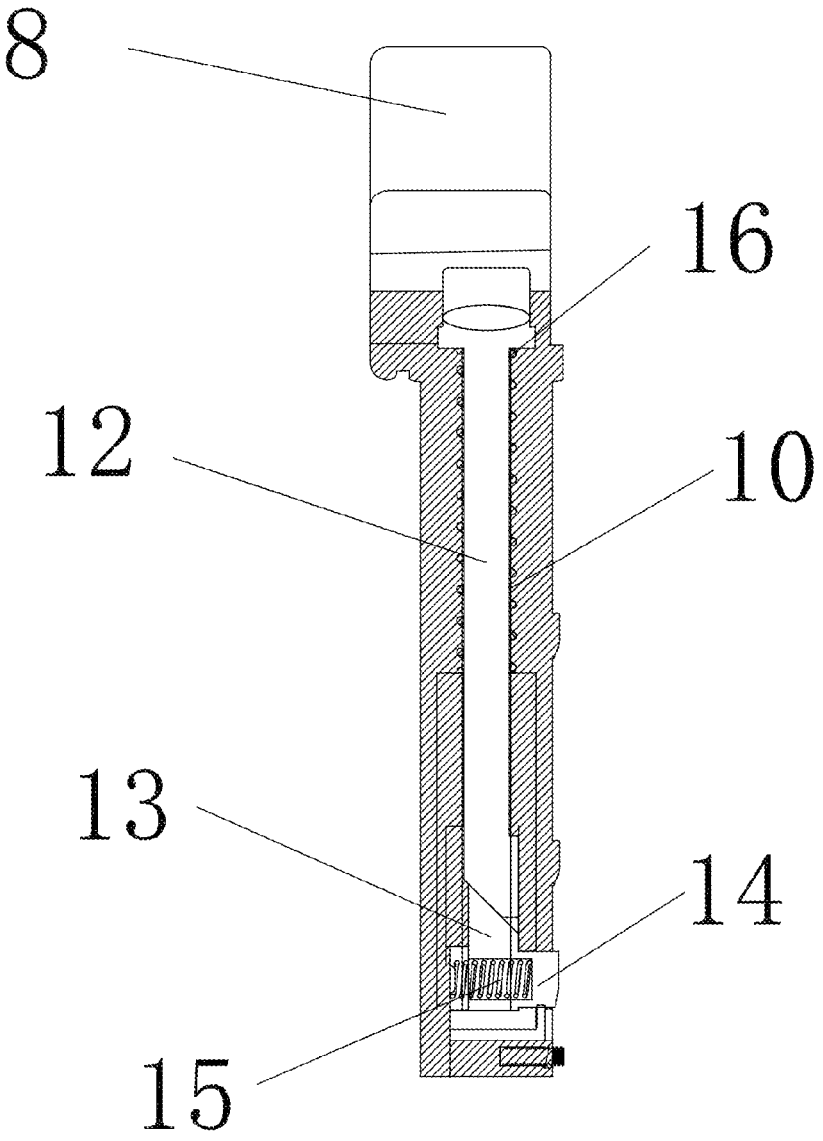
FIG. 8 is a sectional view from the rear end of the leg rest assembly with vertical beam.
Figure 9:
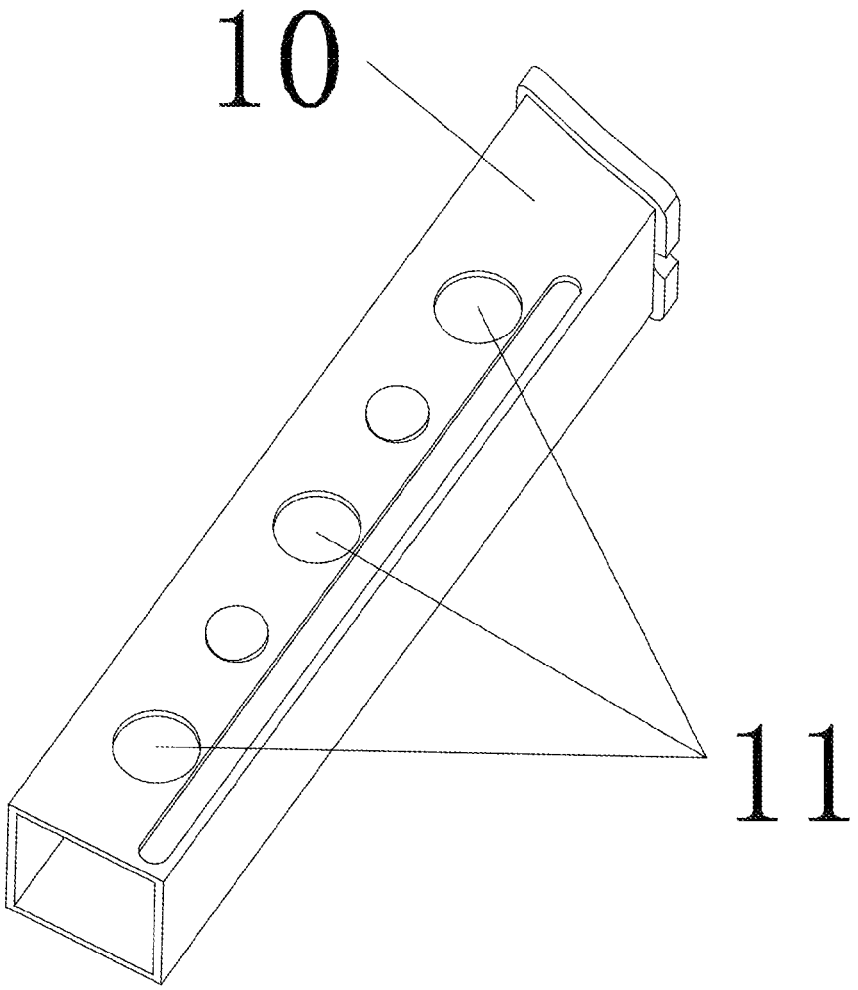
FIG. 9 is a schematic three dimensional view of a leg rest sleeve according to one embodiment of the present invention.
Figure 10:
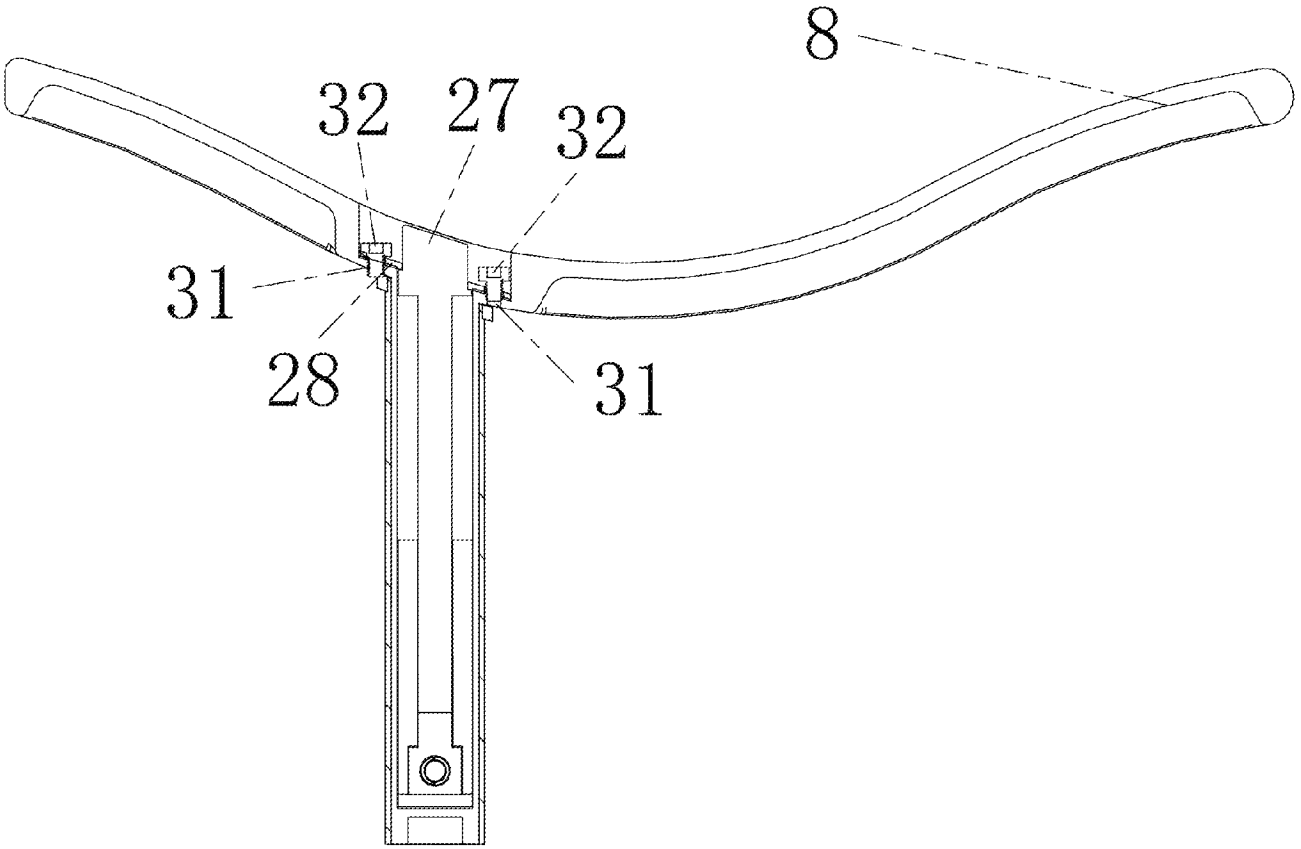
FIG. 10 shows the rear side view of a leg rest assembly with vertical beam according to one embodiment of the present invention, where the leg rest sleeve is removed to show other details.
Figure 11:
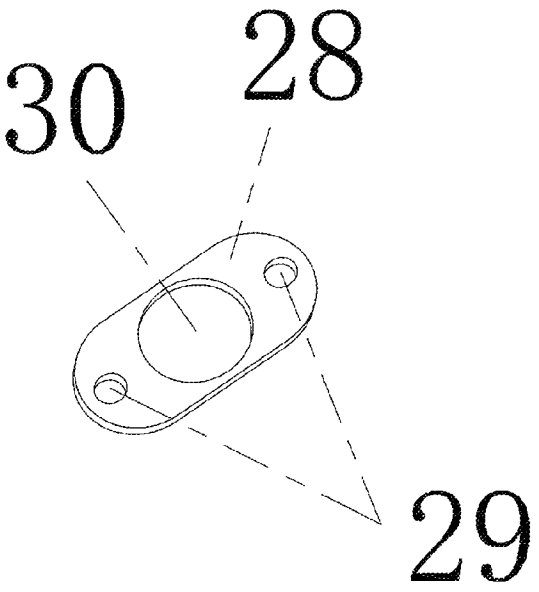
FIG. 11 schematically shows a three dimensional view of a button retainer plate according to one embodiment of the present invention.
Figure 12A:
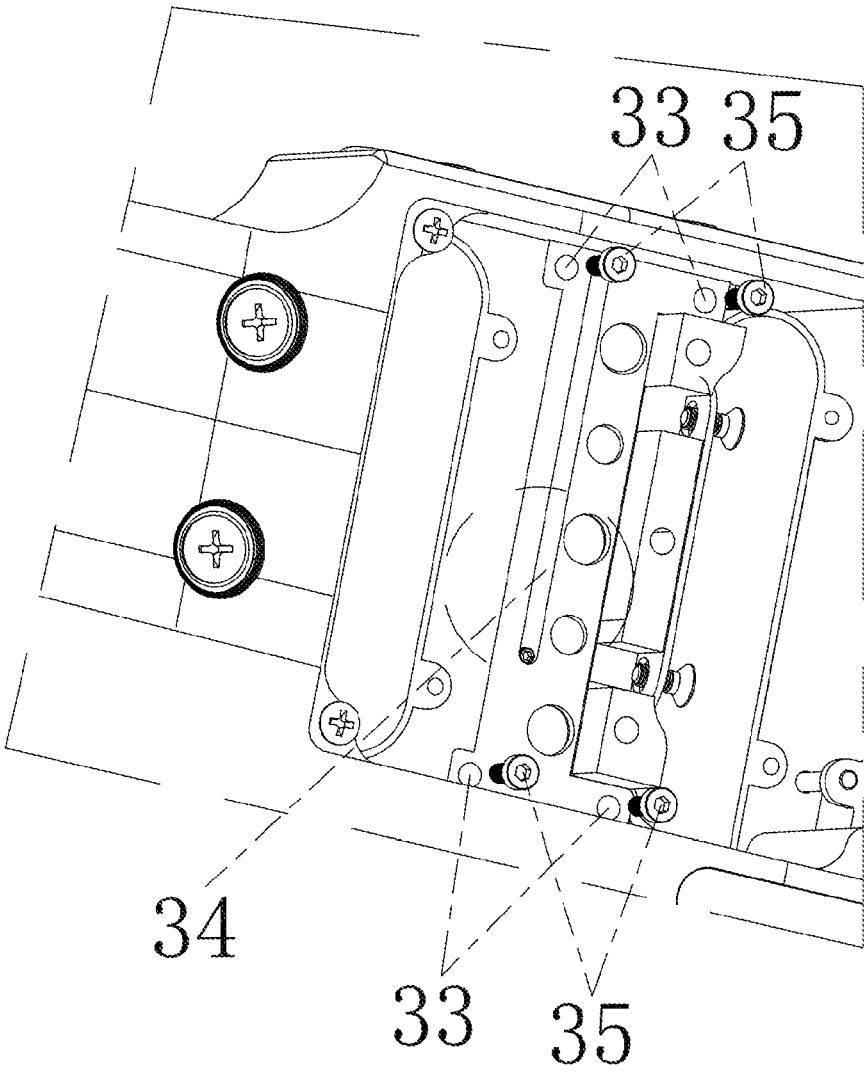
FIG. 12A schematically shows how a leg rest sleeve of the foldable guitar is fixed to the main body according to one embodiment of the present invention.
Figure 12B:
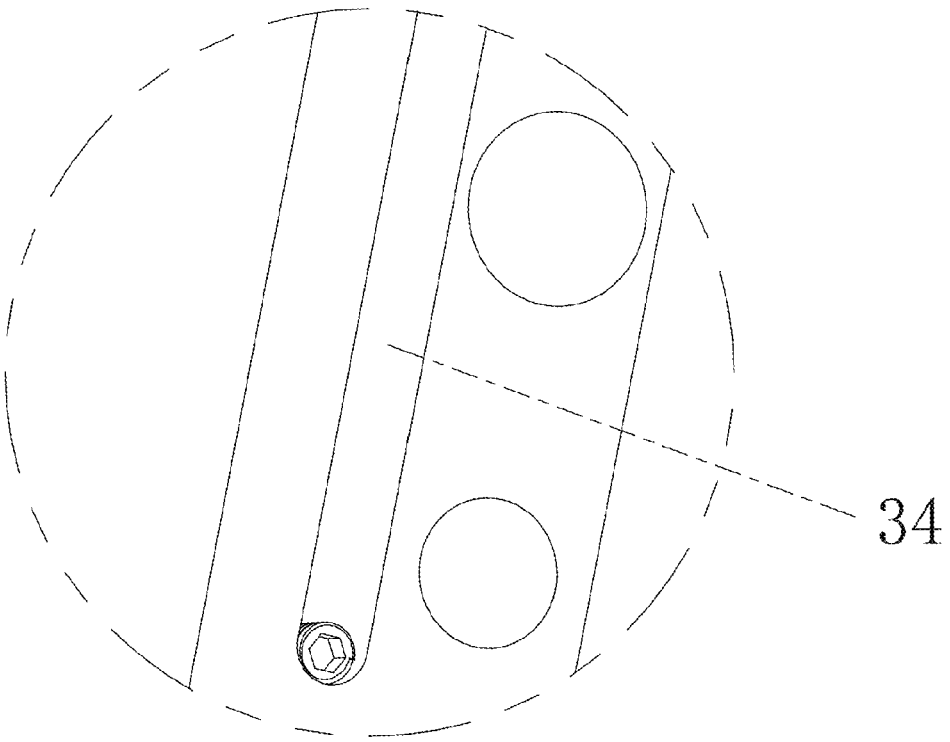
FIG. 12B is an enlarged view of the circled part in FIG. 12A.

The rotating bar 3 has a top end and a bottom end that make full permanent contact to the main body 2. As shown in FIGS. 4A, 4B, 6A and 6B, there are two limiting holes 4 and two limiting holes 21 placed respectively at the two ends of the rotating bar 3. Referring to FIG. 4B, a spring 5 and a ball bearing 6 are received in the limiting hole 4. For the limiting hole 4 located at the bottom end of the rotating bar 3, the spring 5 is located at the bottom side, and the ball bearing 6 is located at the top side. The spring 5 and the ball bearing 6 are held in place into the hole 4 by means of a screw 22. The amount of tension threading the screw 22 screwing into the hole 4 is used to adjust the firmness of the lock of the ball bearing 6. The ball bearing 6 locks the rotating bar 3 into either the folded or the fully extended position with the aid of a locking plate 7. In certain embodiments, as shown in FIG. 5, the locking plate 7 has three holes. These holes are identified as a mounting hole 23, a folded position locking hole 24, and an extended position locking hole 25. The ball bearing 6 is able to move inward or outward from the hole 4 by means of compressing the spring 5, when an external force is applied to the rotating bar 3. This enables the ball bearing 6 to be flush to the surface of the rotating bar 3, allowing freedom of the rotating bar 3 to rotate. When the rotating bar 3 is rotated into the full rotated position or the folded position, the ball bearing 6 is extended outward from the surface of the rotating bar 3 to the folded position locking hole 24 on the locking plate 7. By means and force provided by the spring 5, the amount of force of the locking procedure is set by the screw 22. Under this situation, the ball bearing 6 is aligned and engaged with the locking hole 24 on the locking plate 7, the rotating bar 3 is press fit with the main body 2 through the ball bearing 6 and the locking hole 24, and the rotating bar 3 is in the folded position. The ball bearing 6 is also able to lock the rotating bar 3 into the fully extended position. When the rotating bar 3 is rotated into the full extended rotated position or the working position, as shown in FIG. 4B, the ball bearing 6 is extended outward from the surface of the rotating bar 3 to the extended position locking hole 25. Under this situation, the ball bearing 6 is aligned and engaged with the locking hole 25 on the locking plate 7, the rotating bar 3 is press fit with the main body 7 through the ball bearing 6 and the locking hole 25, and the rotating bar 3 is in the extended or working position. A screw 20 attaches the rotating bar 3 and the lock plate 7 to the main body 2. The screw 20 goes through a hole 21 as slip fit on the rotating bar 3. The screw 20 also goes through the hole 23 on the lock plate 7. The lock plate 7 is fitted between the rotating bar 3 and the main body 2. The screw 20 is threaded into a hole 26 on the main body 2. In other words, the screw 20 passes sequentially the hole 21 on the rotating bar 3, the hole 23 on the lock plate 7, and the hole 26 on the main body 2, to rotatably fix the rotating bar 3 to the main body 2. The screw 20 not only secures the rotating bar 3 to the main body 2, but also provides center pivot point to the rotating bar 3. The profile of the locking plate 7 is located in counter bore recess in the main body 2 to keep the locking plate 7 in permanent fixed position relative to the main body 2. Counter bore on the main body 2 matches the shape of the locking plate 7, this method of attaching the locking plate 7 reduces the materials needed to keep the locking plate 7 in desired fixed position. The union of the locking plate 7 and the main body 2 provide accurate prescribed locking positions for the rotating bar 3. In certain embodiments, the locking plate 7 is integrally formed with the main body 2.

As shown in FIGS. 7-12B, leg rest components 4 includes leg rest 8, vertical beam 9, leg rest sleeve 10, leg rest position hole 11, push rod 12, toggle bolt 13, guide pin 14, spring 15, spring 16, push rod button 27, button retainer plate 28, button retainer plate mount hole 29, button retainer button hole 30, leg rest button retainer plate mount hole 31, button retainer plate screw 32, leg rest sleeve mounting hole 33, leg rest sleeve guide pin channel 34, and leg rest sleeve mount screw 35.

In certain embodiments, the leg rest 8 is attached to the main body 2 through the leg rest sleeve 10. The leg rest sleeve 10 is permanently fixed to the main body 2 through the leg rest sleeve mounting screw 35. The leg rest sleeve mounting screw 35 has slip fit through the leg rest sleeve mounting hole 33. The mounting screw 35 is firmly threaded into the main body 2 and fixes the leg rest sleeve 10 to the main body 2. The vertical beam 9 is inserted inside the leg rest sleeve 10. The leg rest 8 is permanently fixed to the vertical beam 9. The vertical beam 9 is attached to the leg rest sleeve 10 by means of the guide pin 13 and the toggle bolt 13. The vertical beam 9 has the guide pin 14 pressed into press fit hole on the vertical beam 9 after vertical beam 9 is inserted into the leg rest sleeve 10. The guide pin 14 is held in place on the leg rest sleeve 10 by means of the leg rest sleeve guide pin channel 34. The vertical beam 9 is also held in place by means of the toggle bolt 13. The toggle bolt 13 can be engaged or disengaged into the leg rest position hole 11 located on the leg rest sleeve 10. The leg rest 8 has capability of being positioned in multiple prescribed positions. This is achieved using the toggle bolt 13 loaded with the spring 15 and the spring 16. The toggle bolt 13 can be drawn inward into the vertical beam 9 by pushing the push rod button 27. The push rod button 27 makes contact to the push rod 12 when the push rod button 27 is pushed inward. The push rod 12 has beveled edge that contacts the toggle bolt 13. The toggle bolt 13 has opposing beveled edge that the beveled edge of the push rods 12 makes contact with. When the push rod button 27 is pushed, the bevel of the push rod 12 engages with the bevel of the toggle bolt 13, and the more the contact occurs the more inward the toggle bolt 13 moves inside the vertical beam 9. The push rod 12 and the toggle bolt 13 are mounted with springs 15 and 16, which can return the toggle bolt 13 into upward locking position. The spring 15 is in direct contact with the toggle bolt 13 always applying upward pressure. The spring 16 is in direct contact with the push rod 12 always applying upward pressure to disengage the push rod 12 from the toggle bolt 13. The spring 15 has enough pressure to push the toggle bolt 13 up through the hole 11 located in the leg rest sleeve 10. When the toggle bolt 13 is engaged into the hole 11 of the leg rest sleeve 10, it then locks the leg rest 8 into one of many locking positions. The action of the toggle bolt 13 is held together in the housing provided by the vertical beam 9 and combines movements of the push rod 12, the toggle bolt 13, the spring 15, the spring 16, the push rod button 27, the button retainer plate 28, and the button retainer screw 32.

The purpose and advantage according to certain embodiments of this invention are to provide a full size stringed musical instrument that has familiar feel, to position stringed instrument to a status that musicians are accustomed to, and to provide a full size stringed musical instrument that is portable and easier to move with traveling musicians. This invention also provides an instrument more resilient against damage while being transported. This invention can provide more portable means to any Spanish or Classical style stringed musical instrument. Most notable electric guitar and bass instruments, including the Classical style large Upright bass type of stringed musical instrument.

The foregoing description of the exemplary embodiments of the invention has been presented only for the purposes of illustration and description and is not intended to be exhaustive or to limit the invention to the precise forms disclosed. Many modifications and variations are possible in light of the above teaching.

The embodiments were chosen and described in order to explain the principles of the invention and their practical application so as to activate others skilled in the art to utilize the invention and various embodiments and with various modifications as are suited to the particular use contemplated. Alternative embodiments will become apparent to those skilled in the art to which the present invention pertains without departing from its spirit and scope. Accordingly, the scope of the present invention is defined by the appended claims rather than the foregoing description and the exemplary embodiments described therein.

The invention claimed is:

1. A foldable guitar having a guitar body, the guitar body comprising:

a main body; and a rotating bar having a top end and a bottom end, wherein each of the top end and the bottom end is pivoted to the main body, a shape of the rotating bar matches a profile shape of the main body, and the rotating bar is foldable, such that a size of the guitar body is reduced when the rotating bar is folded toward the main body;

wherein at least one of the top end and the bottom end of the rotating bar comprises a ball bearing disposed therein, an outer portion of the ball bearing receives a force pressing the ball bearing inward toward the main body, and the inner portion of the ball bearing is exposed toward the main body;

wherein the main body comprises a first hole and a second hole configured to receive the ball bearing;

wherein when the ball bearing slip fits with the first hole, the rotating bar is in an extended position such that the foldable guitar can be used normally; and wherein when the ball bearing slip fits with the second hole, the rotating bar is in a folded position such that the rotating bar is folded on the main body.

2. The foldable guitar according to claim 1, wherein a set screw is placed at the outer side of the ball bearing, and the set screw is used to adjust the force pressing the ball bearing inward toward the main body.

3. The foldable guitar according to claim 1, further comprising a retractable leg rest, a vertical support beam, and a sleeve, wherein the retractable leg rest is fixed to the vertical support beam, the sleeve is sleeved on the vertical support beam, and the sleeve is fixed in the main body.

4. The foldable guitar according to claim 3, wherein a receptacle the retractable leg rest resides in allows for multiple locking positions of the retractable leg rest, a locking positioning of the leg is performed with a spring loaded toggle bolt locking mechanism, the toggle bolt is configured such that an end user does not require any tools to activate the adjustment of the retractable leg rest, the spring loaded toggle bolt is retractable from locking position by means of a spring loaded push button release, the toggle bolt can reside in multiple holes located in the sleeve residing in the main body of the foldable guitar.

5. The foldable guitar according to claim 1, further comprising an electric amplifier attachable and removable from the main body of the guitar, wherein an output signal from the guitar vibrating string is feed into the attachable electric amplifier by means of permanent magnetic inductor or inductors.

6. A foldable guitar having a guitar body, the guitar body comprising:

a main body;

a rotating bar having a top end and a bottom end, wherein each of the top end and the bottom end is pivoted to the main body, a shape of the rotating bar matches a profile shape of the main body, and the rotating bar is foldable, such that a size of the guitar body is reduced when the rotating bar is folded toward the main body;

a retractable leg rest;

a vertical support beam; and a sleeve, wherein the retractable leg rest is fixed to the vertical support beam, the sleeve is sleeved on the vertical support beam, and the sleeve is fixed in the main body; and wherein a receptacle the retractable leg rest resides in allows for multiple locking positions of the retractable leg rest, a locking positioning of the leg is performed with a spring loaded toggle bolt locking mechanism, the toggle bolt is configured such that an end user does not require any tools to activate the adjustment of the retractable leg rest, the spring loaded toggle bolt is retractable from locking position by means of a spring loaded push button release, the toggle bolt can reside in multiple holes located in the sleeve residing in the main body of the foldable guitar.

* * * * *